US006302479B1

(12) United States Patent
Zheng

(10) Patent No.: US 6,302,479 B1
(45) Date of Patent: Oct. 16, 2001

(54) FOLDABLE BEACH CHAIR

(75) Inventor: Edward Zheng, La Verne, CA (US)

(73) Assignee: Tofasco of America, Inc., La Verne, CA (US)

( * ) Notice: Subject to any disclaimer, the term of this patent is extended or adjusted under 35 U.S.C. 154(b) by 0 days.

(21) Appl. No.: 09/662,041

(22) Filed: Sep. 15, 2000

(51) Int. Cl.[7] ..... A47C 4/48
(52) U.S. Cl. ..... 297/16.2; 297/45
(58) Field of Search ..... 297/16.1, 16.2, 297/45, 59; 248/164, 432

(56) References Cited

U.S. PATENT DOCUMENTS 467,340 * 1/1892 Chichester ..... 248/432
2,625,207 * 1/1953 Duke ..... 297/45
2,691,410 * 10/1954 Boucher ..... 297/440.11 X
5,499,857 * 3/1996 Lynch, Jr. ..... 297/16.2

FOREIGN PATENT DOCUMENTS

2532535 * 3/1984 (FR) ..... 297/16.2

* cited by examiner

*Primary Examiner*—Peter R. Brown
(74) *Attorney, Agent, or Firm*—Raymond Y. Chan; David & Raymond Patent Group

(57) ABSTRACT

A foldable beach chair includes a seat frame and a back frame constructed to support a fabric seat thereon, wherein the seat includes a pair of foldable supporting arms foldable and vertically biasing against two pairs of side frame legs respectively when the foldable beach chair is unfolded to stretch out. Therefore, the foldable beach chair provides a low height strong frame structure that can well support the user's weight.

18 Claims, 9 Drawing Sheets

FOLDABLE BEACH CHAIR

BACKGROUND OF THE PRESENT INVENTION

1. Field of Invention

The present invention relates to a beach chair, and more particularly to a foldable beach chair which is facilitated to be folded into a compact unit for storage and carriage.

2. Description of Related Arts

The distinctive feature of a beach chair is its low height. Normally, a beach chair merely has half height of normal chair. As shown in FIG. 1, a conventional folding chair is illustrated. If its height is reduced in half, the angle between each of the inclined legs with the ground must be reduced to a half, too. It will damage its supporting structure that highly decreases the supporting ability thereof while maintaining the same width of the folding chair. In other words, the cross tube structure of the conventional folding chair limits the height of the chair.

Therefore, due to the low height requirement of the beach chair, as shown in FIGS. 2A, and 2B, the common foldable beach chair comprises a chair seat A2 which is made of durable fabric and a chair seat A1 which is constructed by a set of metal tubes. The chair frame A1 for supporting the chair seat A2 comprises a seat frame A12, a back frame A14 for supporting the seat frame A12 pivotally mounted underneath the seat frame A12, and a pair of pivotal arms A15 each pivotally connecting between the seat frame A12 and the back frame A13. In order to fold the conventional foldable beach chair, fold the back frame A13 toward the seat frame A12 by rotating the pivotal arms A15 outwardly and fold the leg frame A14 underneath and into the seat frame A12. The folded beach chair is bulky and difficult to carry because the size of the beach chair is limited by its seat frame A12. Also, the beach chair is usually heavy since the chair frame A1 must be constructed sturdily, in order to support a user' weight.

SUMMARY OF THE PRESENT INVENTION

A main object of the present invention is to provide a foldable beach chair, which provides a low height strong frame structure that can well support the weight of the user.

Another object of the present invention is to provide a foldable beach chair, which comprises an inclined back frame structure to enable the user's back to comfortably lie on the beach chair.

Another object of the present invention is to provide a foldable beach chair, which has a simple construction that every individual is able to fold and unfold the carriage.

Another object of the present invention is to provide a foldable beach chair, which is adapted for being folded into a compact unit for easily storage and carriage.

Accordingly, in order to accomplish the above objects, the present invention provides a foldable beach chair, comprising a seat frame and a back frame constructed to support a fabric seat thereon, wherein the seat frame comprises:

a pair of front frame legs pivotally connected with each other in cross manner to form a pivotal "X" structure;

a pair of back frame legs pivotally connected with each other in cross manner to form a pivotal "X" structure;

two pairs of side frame legs, each pair comprising a first side frame leg and a second side frame leg pivotally connected with each other in cross manner to form a pivotal "X" structure;

a pair of front lower frame joints for pivotally connecting two lower ends of the two front frames legs with two lower front ends of side frame legs respectively;

a pair of back lower frame joints for pivotally connecting two lower ends of the two back frame legs with two lower ends of the side frame legs respectively;

a pair of front pivot joints for pivotally connecting two upper ends of the two upper ends of the two front frame legs with two upper back ends of the side frame les respectively;

a pair of back upper frame joints for pivotally connecting two upper ends of the two back frame legs with two upper back ends of the side frame legs respectively;

a pair of foldable supporting arms each having a pivot end pivotally connected with one of the two crossed side frame legs of the respective pair of side frame legs in such a manner that a supporting end of each of the supporting arms is extended to bias against the other side frame legs of the respective pair of side frame legs when the foldable beach chair is unfolded to stretch out; and a guiding means for guiding each supporting arm to bias against the side frame legs of the respective pair of side frame legs.

DETAILED DESCRIPTION OF THE PREFERRED EMBODIMENT

Figure 1:
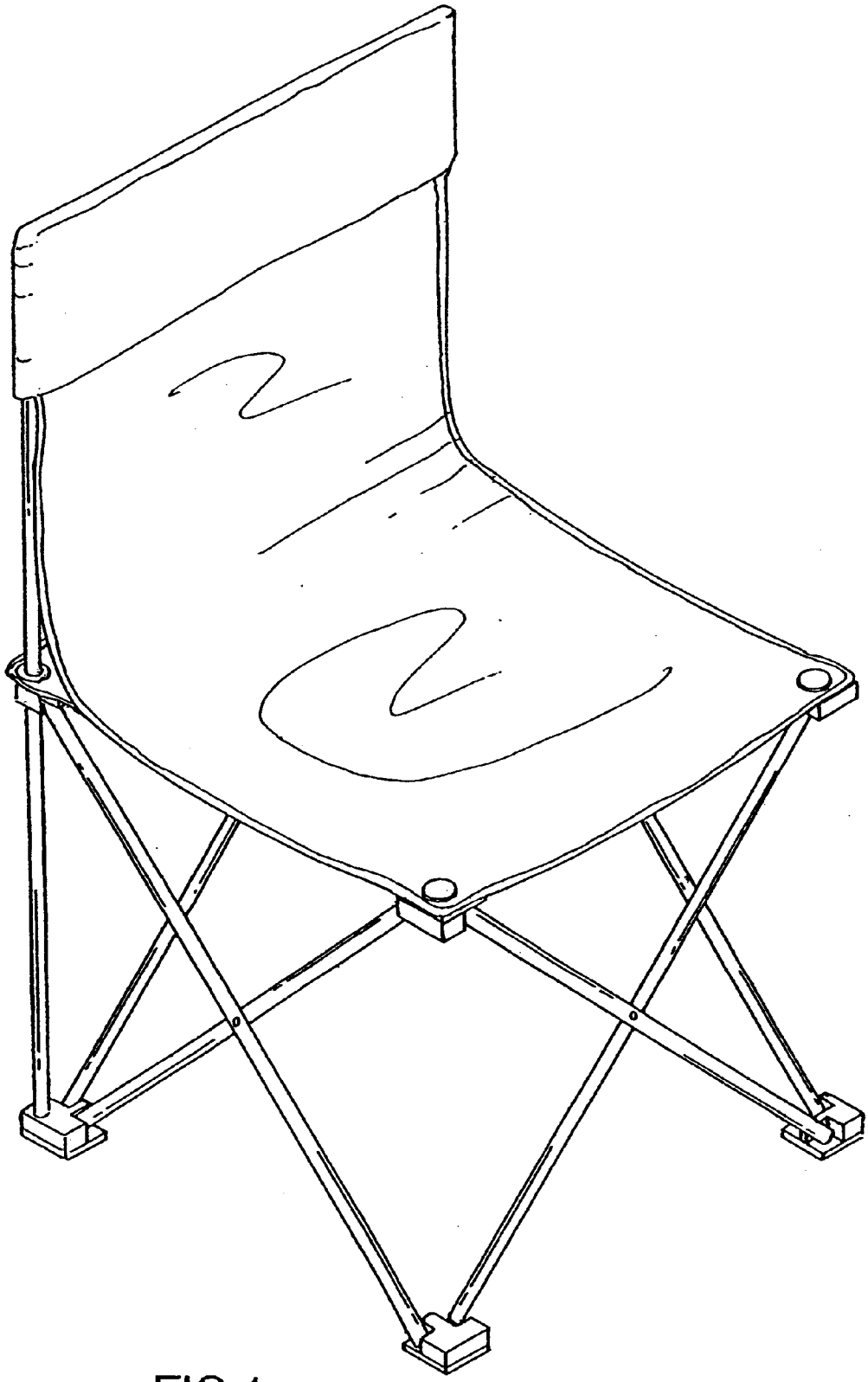
FIG 1 Prior Art
FIG. 1 a perspective view of a conventional folding chair.
Figure 2A:
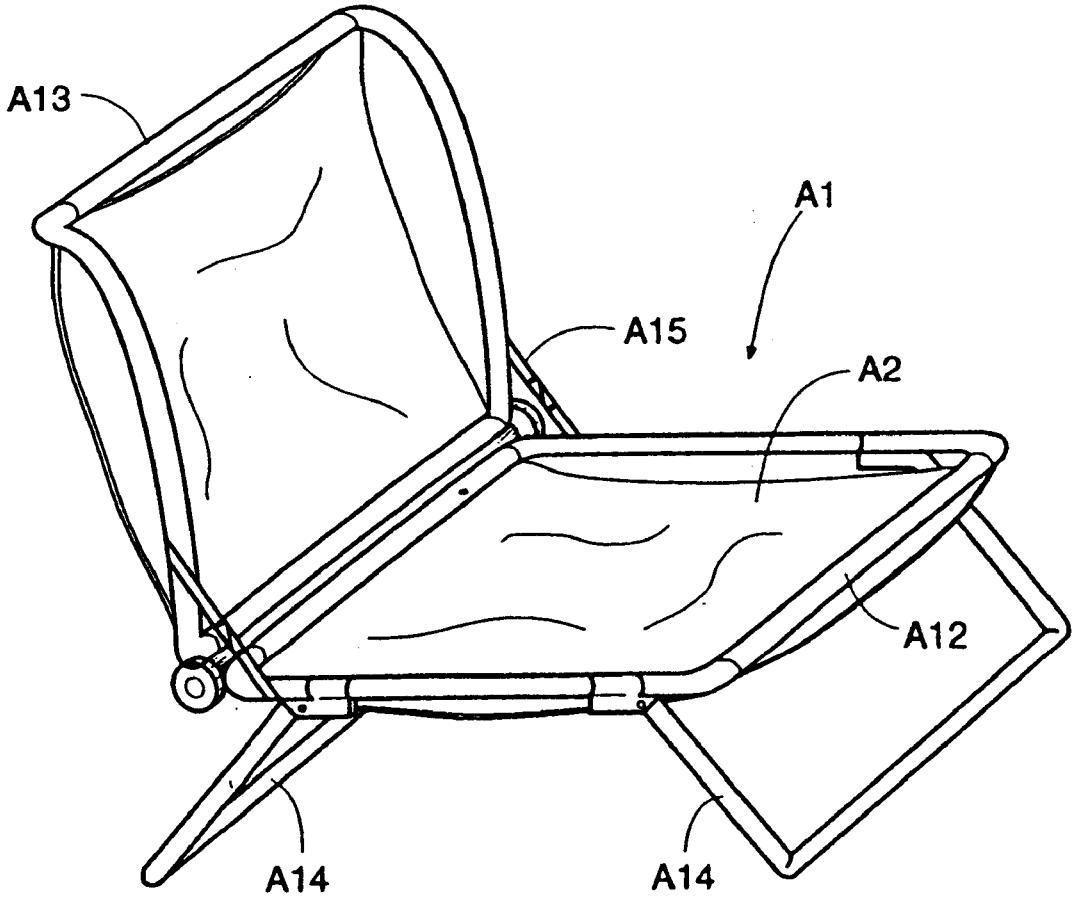
FIG 2A Prior Art
FIG. 2A is a perspective view of a conventional foldable beach chair in the unfolded state.
Figure 2B:
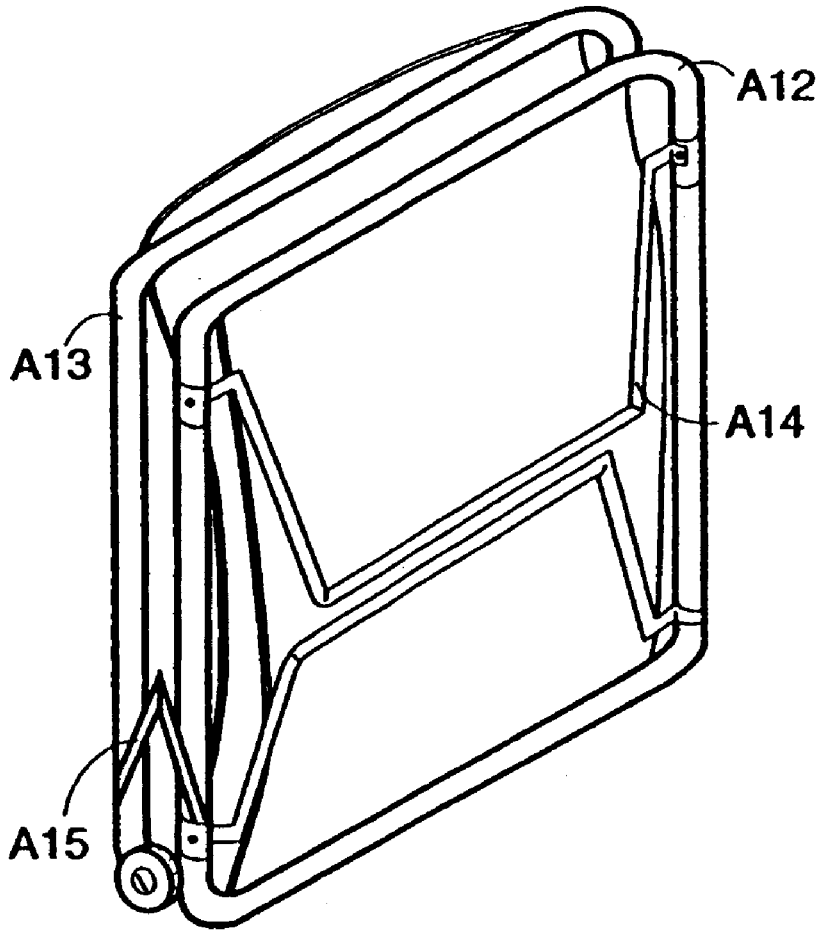
FIG 2B Prior Art
FIG. 2B is a perspective view of the conventional foldable beach chair in the folded state.
Figure 3:
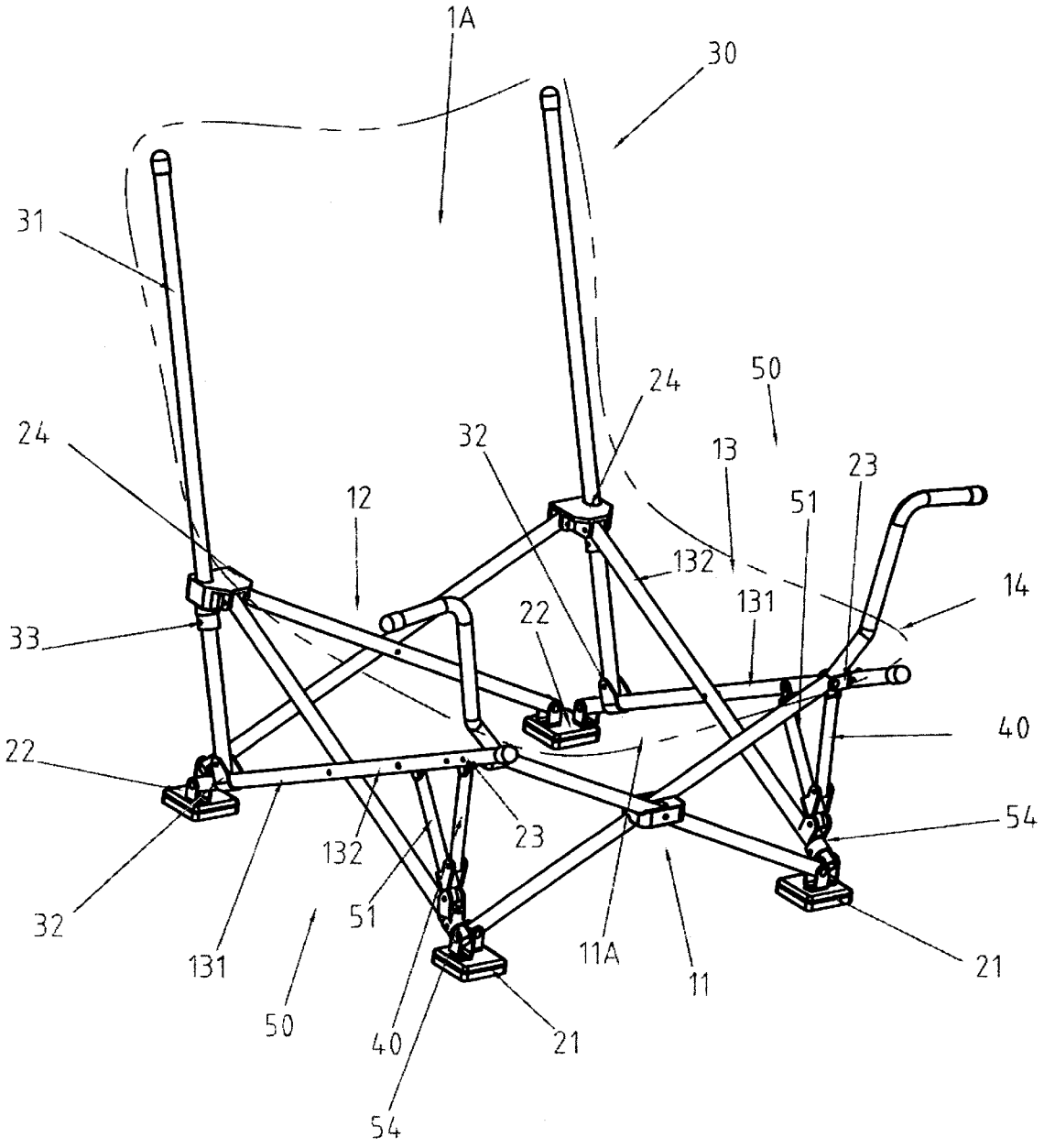
FIG. 3 is a perspective view of a foldable beach according to a preferred embodiment of the present invention.

Referring to FIG. 3 of the drawings, a foldable beach chair 1 is illustrated, which comprises a seat frame 10 and a back frame 30 constructed to support a fabric seat 1A thereon, wherein the back frame 30 is foldably coupled with the seat frame 10.

The seat frame 10 comprises a pair of front frame legs 11 pivotally connected with each other in cross manner to form a pivotal "X" structure, a pair of rear frame legs 12 pivotally connected with each other in cross manner to form a pivotal "X" structure, and two pairs of side frame legs 13 wherein each pair of side frame legs 13 comprises a first side frame leg 131 and a second side frame leg 132 pivotally connected with each other in cross manner to form a pivotal "X" structure.

In addition, a pair of seat supporting arms 14 are frontwardly and integrally extended from two upper ends of the two first side frame legs 131 respectively wherein a thigh supporting flap 11A frontwardly extended from the fabric seat 1A is firmly supported by the seat supporting arms 14 so as to substantially increase the seat area of the fabric seat 1A.

The seat frame 10 further comprises a pair of front lower frame joints 21 for pivotally connecting two lower ends of the two front frames legs 11 with two lower front ends of side frame legs 13 respectively, a pair of back lower frame joints 22 for pivotally connecting two lower ends of the two rear frame legs 12 with two lower ends of the side frame legs 13 respectively, a pair of front pivot joints 23 for pivotally connecting two upper ends of the two upper ends of the two front frame legs 11 with two upper back ends of the side frame legs 13 respectively, and a pair of back upper frame joints 24 for pivotally connecting two upper ends of the two rear frame legs 12 with two upper back ends of the side frame legs 13 respectively.

The back frame 30 comprises a pair of inclined back frame legs 31 slidably penetrating through the two back upper frame joints 24 respectively, wherein two lower ends of the two back frame legs 31 are respectively extended downwardly to pivotally connected to two U-shaped pivotal joint 32 which are affixed to a lower portion of the two side frame legs 13 respectively. The inclination of the back frame 30 depends on where the two pivotal joints 32 connect with the two side frame legs 13. Substantially, the back frame 30 will be more inclined with respect to the seat frame 10 when the two lower ends of the two rear frame legs 12 are connected with the upper portions of the two side frame legs 13 through the pivotal joints 32 respectively. Also, the back frame 30 becomes more vertical when the two pivotal joints 32 are affixed to the two side frame legs 13 at a position closer to the two back lower frame joints 22.

The back frame 30 further comprises a pair of ring shaped stoppers 33 respectively affixed at the lower portions of the two back frame legs 31, positioning between the two back upper frame joints 22 and the two pivot joints 32. The two stoppers 33 are used for blocking and stopping the downward movement of the two back upper frame joints 24 while unfolding and stretching out the foldable beach chair 1, so as to lock up the height of the beach chair 1 and partially support the weight of the user.

Figure 4:
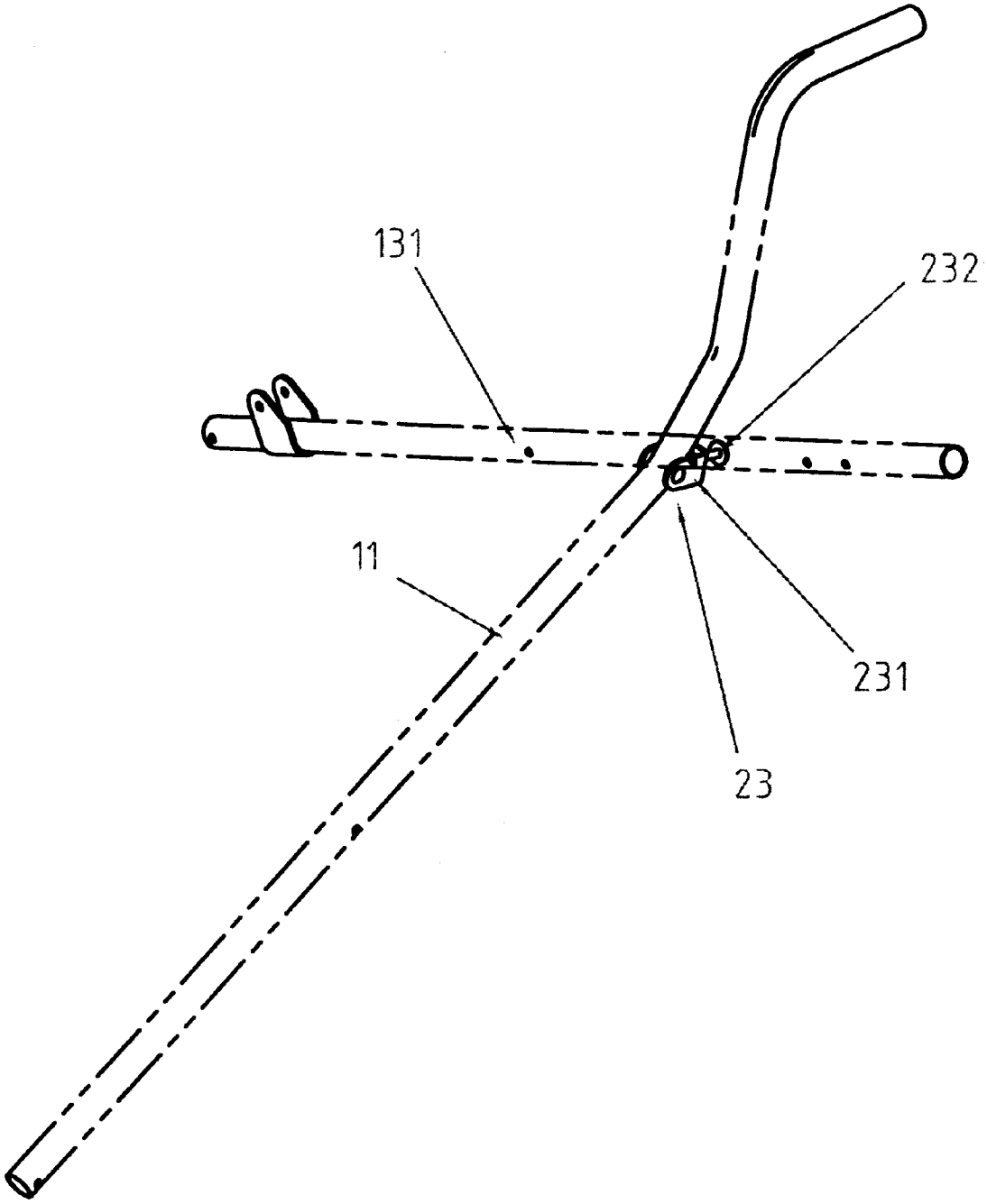
FIG. 4 is a perspective view of the front upper pivot joint of the foldable beach chair according to the above preferred embodiment of the present invention.

As shown in FIG. 4, each of the front pivot joints 23 has a U-shaped head portion 231 and a tail portion 232 wherein the tail portion 232 is rotatably extended from a bottom of the head portion 231. The head portion 231 of the front pivot joint 23 has two ends to pivotally connect the upper end of each front frame leg 11 wherein the tail portion 232 of the front pivot joint 23 is penetrated through the upper back end of each side frame leg 13.

Figure 5:
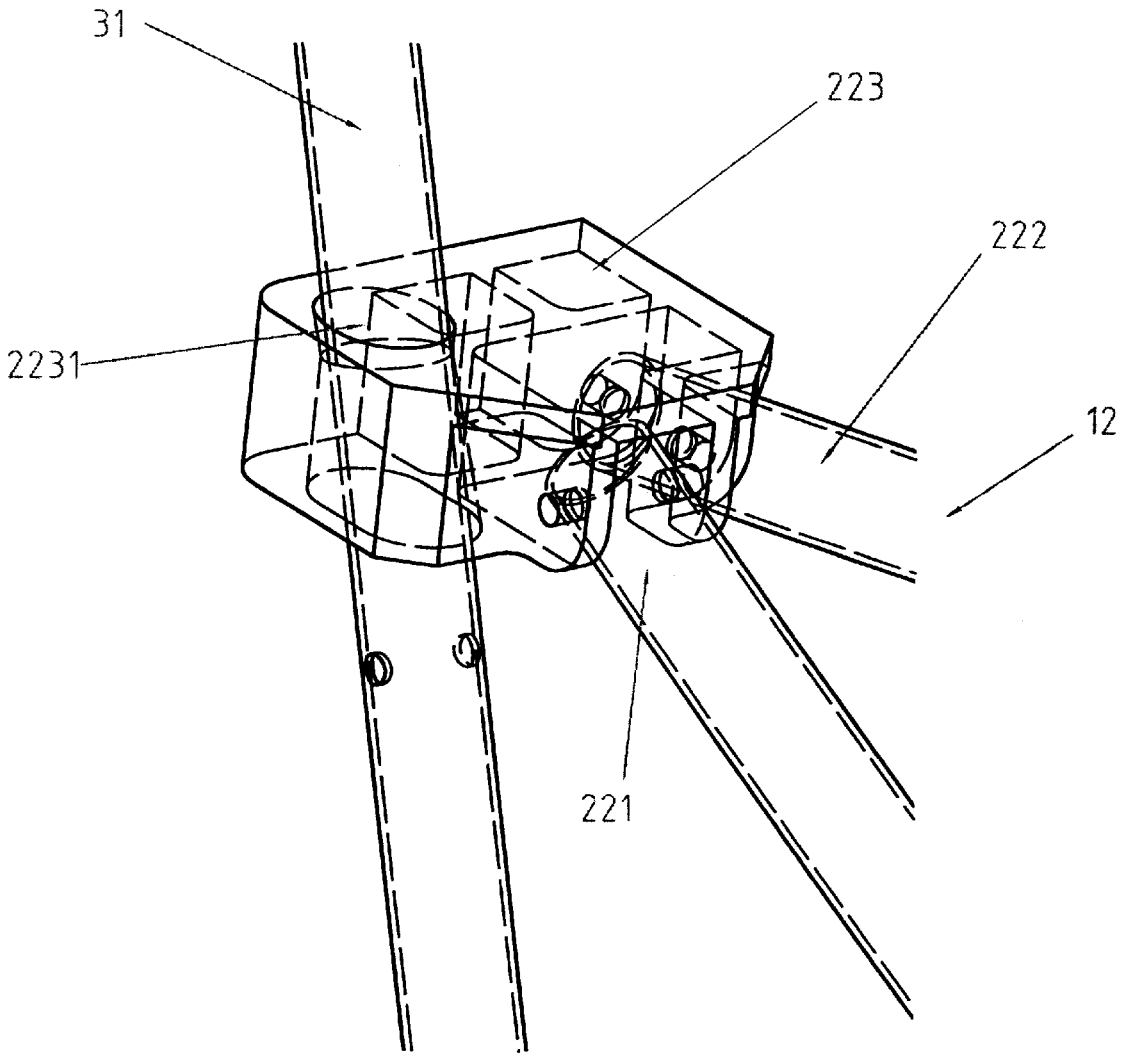
FIG. 5 is a perspective view of the back upper frame joint of the foldable beach chair according to the above preferred embodiment of the present invention.

As shown in FIG. 5, each of the back upper frame joints 22 has a first pivot slot 221 and a second pivot slot 222 for pivotally connecting with the respective side frame leg 13 and the respective rear frame leg 12 respectively, and a slider through hole 223 having an inclined support surface 2231 for supporting the respective inclined back frame leg 31 during the unfolded state, so as to evenly distribute a downward force applied by the user's weight and minimize a stress around the back upper frame joints 22.

Figure 6:
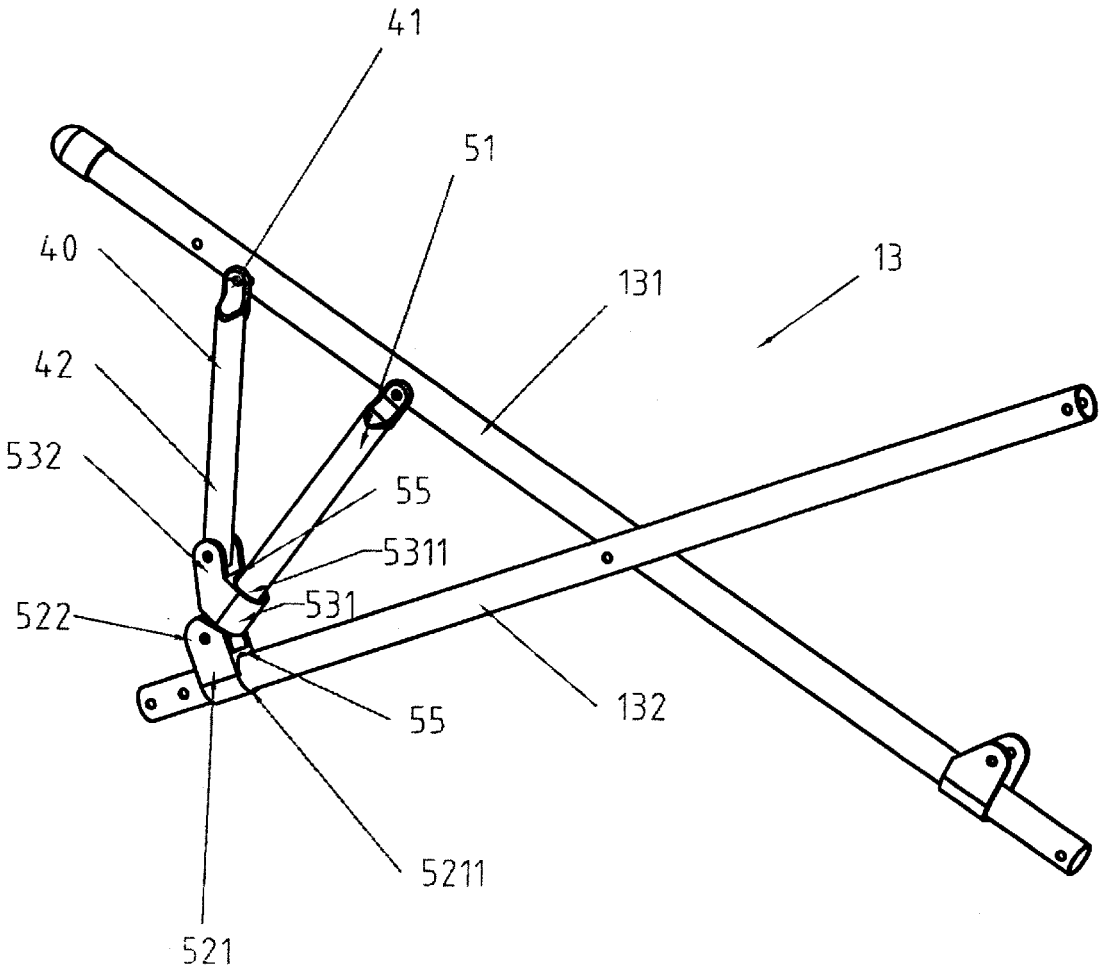
FIG. 6 is a perspective view of the guiding means of the foldable beach chair according to the above preferred embodiment of the present invention.
Figure 7:
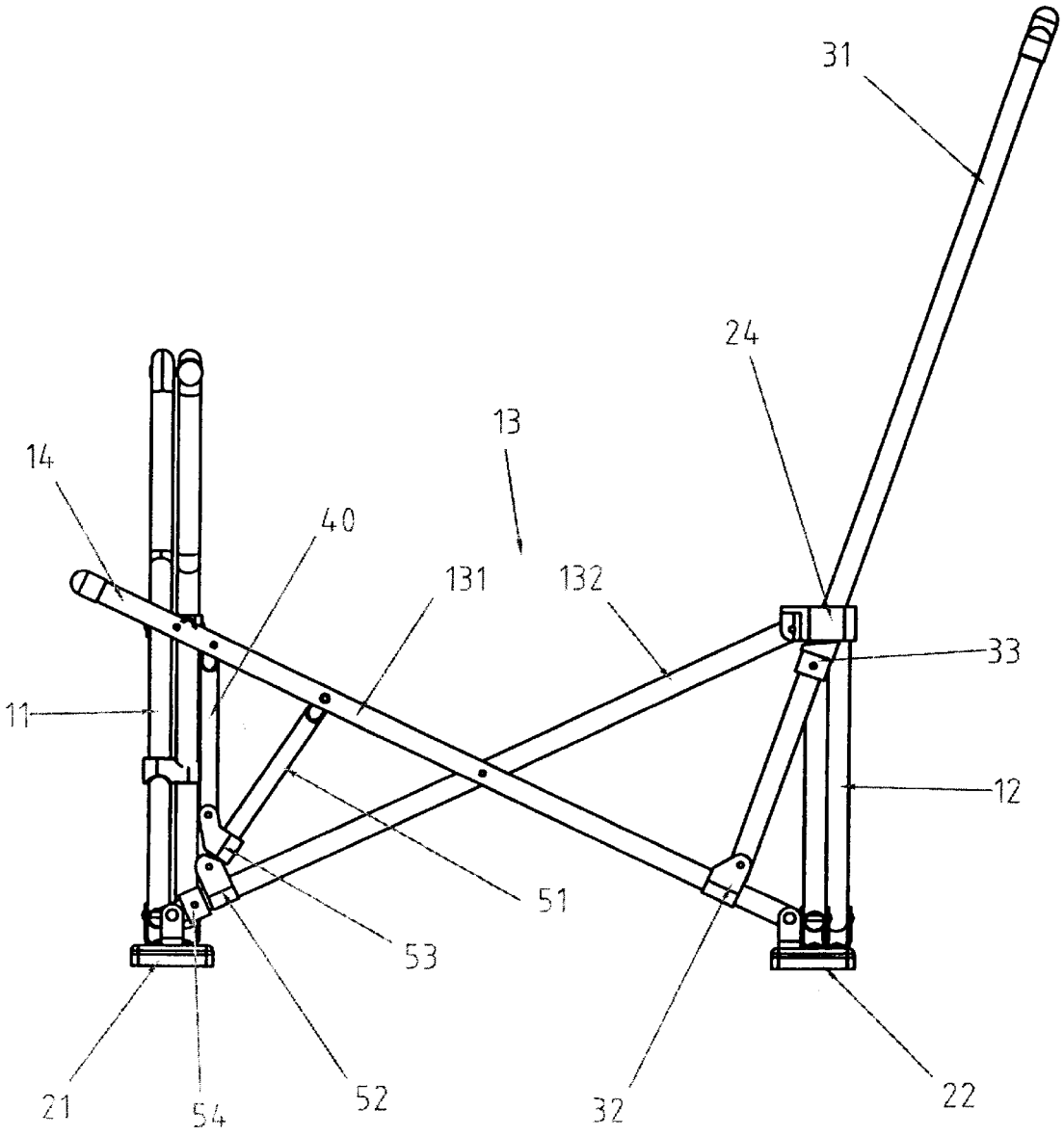
FIG. 7 is a side view of the unfolded foldable beach chair according to the above preferred embodiment of the present invention.
Figure 8:
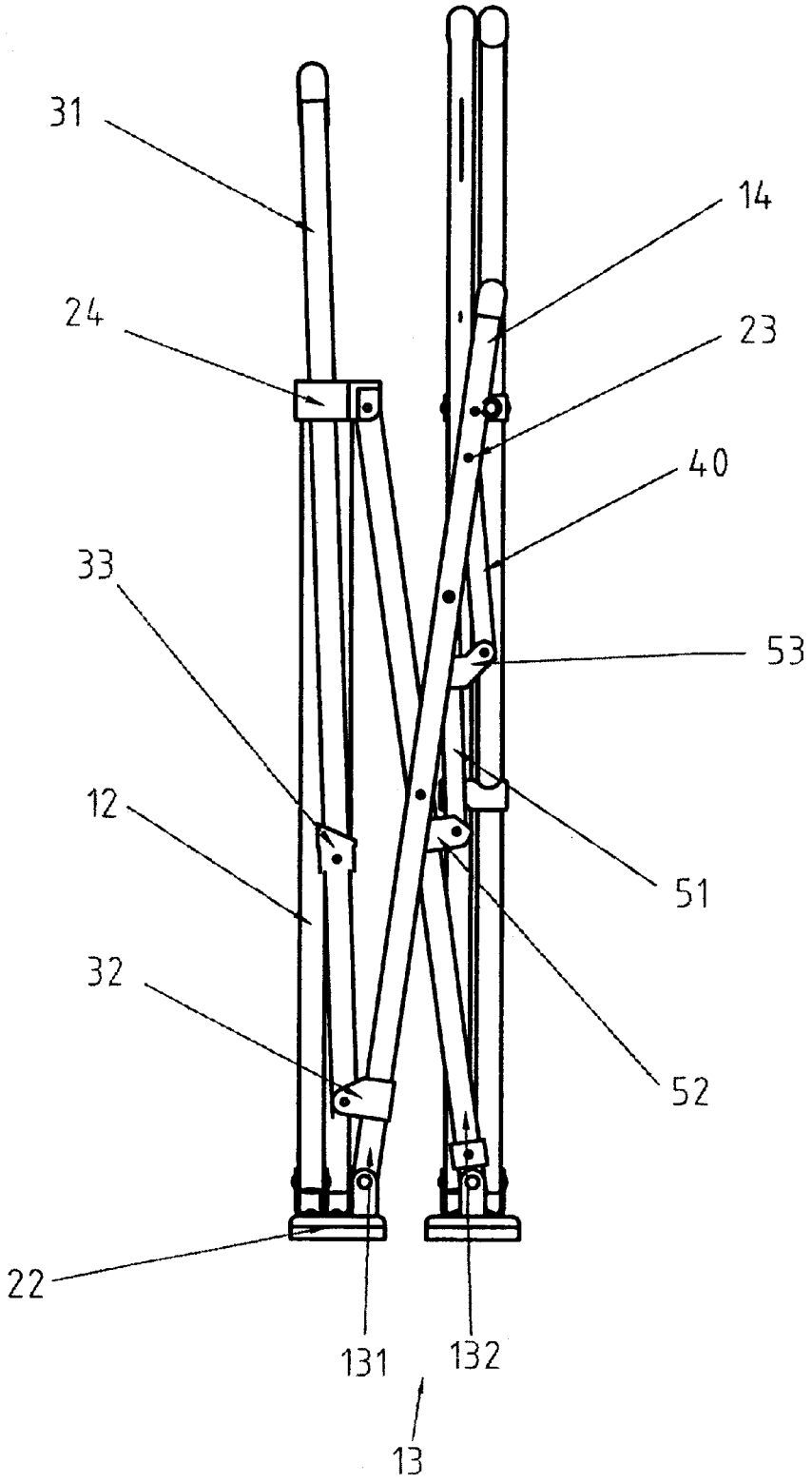
FIG. 8 is a perspective view of the foldable beach chair in the folded state according to the above preferred embodiment of the present invention.

Referring to FIGS. 3 to 8 of the drawings, the foldable beach chair 1 further comprises a pair of foldable supporting arms 40 for mainly supporting the user's weight applied to the front portion of the seat frame 10 in such a manner that the foldable supporting arms 40 can also be folded up when the entire foldable beach chair 1 is folded up as shown in FIG. 8.

Each foldable supporting arm 40 has a pivot end 41 pivotally connected with one of the two crossed side frame legs 13 of the respective pair of side frame legs in such a manner that a supporting end 42 of each of the supporting arms is extended to bias against the other side frame legs 13 of the respective pair of side frame legs when the foldable beach chair 1 is unfolded to stretch out.

Accordingly, the pivot end 41 of each foldable supporting arm 40 is pivotally connected to the upper portion of the first side frame leg 131 and the supporting end 42 of each foldable supporting arm 40 is suspended downwardly in such a manner that each of the foldable supporting arms 40 has a length adapted to press against the respective second side frame leg 132 vertically when the foldable beach chair 1 is in unfolded stated, as shown in FIG. 7, so as to strengthen the cross-structure of the two pairs of side frame legs 13 and support the user's weight applied to the front portion of the foldable beach chair 1 and limit a distance between the front upper pivot joint 23 and the front lower frame joint 21, i.e. the height of the foldable beach chair 1.

Moreover, in order to ensure the foldable supporting arms 40 are vertically supported between the two side frame legs 13 respectively, the foldable beach chair further comprises a guiding means 50 for guiding each supporting arm 40 to bias against the side frame legs 13 of the respective pair of side frame legs, as shown in FIG. 6. The guiding means 50 comprises a pair of guider arms 51 each pivotally connected to the first side frame leg 131, a pair of guiding joints 52 each for slidably connecting the second side frame leg 132 of the respective side frame legs 13 with the guider arm 51, and a pair of supporting joints 53 for slidably connecting the guider arm 51 with the supporting arm 40.

Each guider arm 51 has two ends wherein an upper end thereof is pivotally connected to the upper end of each first side frame leg 131 below the respective front pivot joint 23 and a lower end of the guider arm 51 is pivotally connected to the guiding joint 52. Each guiding joint 52 comprises a guider body 521 and two parallel walls 522 integrally extended therefrom. The guider body 521 has a guiding hole 5211 which has a diameter slightly larger than the respective second side frame leg 132 and transversally extended through the guider body 521 for the respective second side frame leg 132 slidably passing through. The two parallel walls 522 are pivotally connected to the lower end of the guider arm 51 therebetween. Moreover, each supporting joint 53 also comprises a slider body 531 and two parallel supporting arms 532 integrally extended therefrom. The slider body 531 has a slider hole 5311 which has a diameter slightly larger than the respective guider arm 51 and transversally extended through the slider body 531 for the respective guider arm 51 slidably passing through. The two parallel supporting arms 532 are pivotally connected to the supporting end 42 of the foldable supporting arm 40 therebetween.

Therefore, when the user is unfolding the foldable beach chair 1 from its folded state, the two guiding joints 52 will push and guide the two guider arms 52 pivotally slide along the second side frame leg 132 downwardly, respectively in such a manner the two supporting joints 53 will push and guide the supporting ends 42 of the two foldable supporting arms 40 to downwardly slide along the guider arms 52 respectively. So, each foldable supporting arm 40 will vertically support between the first and second side frame legs 131, 132 of the respective pair of side frame legs 13 wherein a bottom surface of each supporting joint 53 is supported by a top surface of the respective guiding joint 52 when the foldable beach chair is in the unfolded state, as shown in FIG. 7.

In order to steadily rest the supporting joints 53 on the guiding joints 52 respectively, the guiding joints 52 each has the inclined top surface in such a manner the bottom surface of the supporting joint 53 will flatly supported on the inclined top surface of the guiding joint 52.

The guiding means 50 further comprises a pair of ring shaped blockers 54 respectively affixed at the lower portions of the two second side frame legs 132, positioning between the two front lower frame joints 21 and the two guiding joints 52. The two blockers 54 are used for blocking and stopping the downwardly movement of the two guiding joints 52 while unfolding and stretching out the foldable beach chair 1, so as to partially supporting the weight of the user.

Since the present invention is purposely used on the beach that the foldable beach chair 1 is set up on the sand, the sand may enter into the guiding joints 52 and the supporting joints 53 which are positioning close to the sand, so as to stick the movement of the guiding joints 52 and the supporting joints 53 on the respectively frame legs. So, the guiding hole 5211 of each guiding joint 52 and the slider hole 5311 of each supporting joint 53 each has a plurality of passing through slots 55 spacedly and transversally mounted on a circumferential surface of the guiding hole 5211 and a circumferential surface of the slider hole 5311 respectively, as shown in FIG. 7. So, the sand is adapted for passing through the passing through slots 55 instead of stuffing in the guiding joints 52 and the supporting joints 53 such that the guiding joints 52 and the supporting joints 53 are freely slid along the second side frame legs 132 and the guider arms 40 respectively.

What is claimed is:

1. A foldable beach chair, comprising a seat frame and a back frame constructed to support a fabric seat thereon, wherein said seat frame comprises:

a pair of front frame legs pivotally connected with each other in cross manner to form a pivotal "X" structure;

a pair of back frame legs pivotally connected with each other in cross manner to form a pivotal "X" structure;

two pairs of side frame legs, each pair comprising a first side frame leg and a second side frame leg pivotally connected with each other in cross manner to form a pivotal "X" structure;

a pair of front lower frame joints for pivotally connecting two lower ends of said two front frames legs with two lower front ends of side frame legs respectively;

a pair of back lower frame joints for pivotally connecting two lower ends of said two back frame legs with two lower ends of said side frame legs respectively;

a pair of front pivot joints for pivotally connecting two upper ends of said two upper ends of said two front frame legs with two upper back ends of said side frame les respectively;

a pair of back upper frame joints for pivotally connecting two upper ends of said two back frame legs with two upper back ends of the said frame legs respectively;

a pair of foldable supporting arms each having a pivot end pivotally connected with one of said two crossed side frame legs of said respective pair of side frame legs in such a manner that a supporting end of each of said supporting arms is extended to bias against said other side frame legs of said respective pair of side frame legs when said foldable beach chair is unfolded to stretch out; and a guiding means, adapted for guiding each supporting arm to bias against said side frame legs of said respective pair of side frame legs, comprising a pair of guider arms each pivotally connected to said first side frame leg, a pair of guiding joints each for slidably connecting said second side frame leg of said respective side frame legs with said guider arm, and a pair of supporting joints for slidably connecting said guider arm with said supporting arm, and wherein a bottom surface of each supporting joint is supported by a top surface of said respective guiding joint when said foldable beach chair is in an unfolded state.

2. A foldable beach chair, as recited in claim 1, wherein each said guider arm has an upper end pivotally connected to said upper end of each said first side frame leg below said respective front pivot joint, and a lower end pivotally connected to said guiding joint.

3. A foldable beach chair, as recited in claims 2 wherein each said guiding joint comprises a guider body and two parallel walls integrally extended therefrom, wherein said guider body has a guiding hole which has a diameter slightly larger than said respective second side frame leg and transversally extended through said guider body for said respective second side frame leg slidably passing through, and said two parallel walls are pivotally connected to said lower end of said guider arm therebetween.

4. A foldable beach chair, as recited in claim 3, wherein each said supporting joint comprises a slider body and two parallel supporting arms integrally extended therefrom, wherein said slider body has a slider hole which has a diameter slightly larger than said respective guider arm and transversally extended through said slider body for said respective guider arm slidably passing through, and said two parallel supporting arms are pivotally connected to said supporting end of said foldable supporting arm therebetween.

5. A foldable beach chair, as recited in claim 4, wherein each said guiding joint has an inclined top surface for being flatly supported by said bottom surface of said respective supporting joint.

6. A foldable beach chair, comprising a seat frame and a back frame constructed to support a fabric seat thereon, wherein said seat frame comprises:

a pair of front frame legs pivotally connected with each other in cross manner to form a pivotal "X" structure;

a pair of back frame legs pivotally connected with each other in cross manner to form a pivotal "X" structure;

two pairs of side frame legs, each pair comprising a first side frame leg and a second side frame leg pivotally connected with each other in cross manner to form a pivotal "X" structure;

a pair of front lower frame joints for pivotally connecting two lower ends of said two front frames legs with two lower front ends of side frame legs respectively;

a pair of back lower frame joints for pivotally connecting two lower ends of said two back frame legs with two lower ends of said side frame legs respectively;

a pair of front pivot joints for pivotally connecting two upper ends of said two upper ends of said two front frame legs with two upper back ends of said side frame les respectively;

a pair of back upper frame joints for pivotally connecting two upper ends of said two back frame legs with two upper back ends of the said frame legs respectively;

a pair of foldable supporting arms each having a pivot end pivotally connected with one of said two crossed side frame legs of said respective pair of side frame legs in such a manner that a supporting end of each of said supporting arms is extended to bias against said other side frame legs of said respective pair of side frame legs when said foldable beach chair is unfolded to stretch out, wherein said pivot end of each said foldable supporting arm is pivotally connected to an upper portion of said first side frame leg and said supporting end of each said foldable supporting arm is suspended downwardly in such a manner that each of said foldable supporting arms has a length adapted to press against said respective second side frame leg vertically when said foldable beach chair is in unfolded stated; and a guiding means, adapted for guiding each supporting arm to bias against said side frame legs of said respective pair of side frame legs, comprising a pair of guider arms each pivotally connected to said first side frame leg, a pair of guiding joints each for slidably connecting said second side frame leg of said respective side frame legs with said guider arm, and a pair of supporting joints for slidably connecting said guider arm with said supporting arm, and wherein a bottom surface of each supporting joint is supported by a top surface of said respective guiding joint when said foldable beach chair is in an unfolded state.

7. A foldable beach chair, as recited in claim 6, wherein each said guider arm has an upper end pivotally connected to said upper end of each said first side frame leg below said respective front pivot joint, and a lower end pivotally connected to said guiding joint.

8. A foldable beach chair, as recited in claim 7, wherein each said guiding joint comprises a guider body and two parallel walls integrally extended therefrom, wherein said guider body has a guiding hole which has a diameter slightly larger than said respective second side frame leg and transversally extended through said guider body for said respective second side frame leg slidably passing through, and said two parallel walls are pivotally connected to said lower end of said guider arm therebetween.

9. A foldable beach chair, as recited in claim. 8, wherein each said supporting joint comprises a slider body and two parallel supporting arms integrally extended therefrom, wherein said slider body has a slider hole which has a diameter slightly larger than said respective guider arm and transversally extended through said slider body for said respective guider arm to slidably pass through, and said two parallel supporting arms are pivotally connected to said supporting end of said foldable supporting arm therebetween.

10. A foldable beach chair, as recited in claim 9, wherein a plurality of passing through slots are spacedly and transversally provided on a circumferential surface of said guiding hole and a circumferential of said slider hole respectively, for preventing said guiding joints and said supporting joints from being stuck during siliding movement so as to ensure that said guiding joints and said supporting joints freely slide along said respective side frame legs and said guider arms respectively.

11. A foldable beach chair, as recited in claim 10, wherein said guiding means further comprises a pair of ring shaped blockers, respectively affixed at said lower portions of said two second side frame legs and positioned between said two front lower frame joints and said two guiding joints, for blocking and stopping a downwardly movement of said two guiding joints while unfolding and stretching out said foldable beach chair, so as to partially supporting a weight of a user.

12. A foldable beach chair, as recited in claim 9, wherein each said guiding joint has an inclined top surface for being flatly supported by said bottom surface of said respective supporting joint.

13. A foldable beach chair, as recited in claim 10, wherein each said guiding joint has an inclined top surface for being flatly supported by said bottom surface of said respective supporting joint.

14. A foldable beach chair, as recited in claim 13, wherein said guiding means further comprises a pair of ring shaped blockers, respectively affixed at said lower portions of said two second side frame legs and positioned between said two front lower frame joints and said two guiding joints, for blocking and stopping a downwardly movement of said two guiding joints while unfolding and stretching out said foldable beach chair, so as to partially supporting a weight of a user.

15. A foldable beach chair, as recited in claim 9, wherein said guiding means further comprises a pair of ring shaped blockers, respectively affixed at said lower portions of said two second side frame legs and positioned between said two front lower frame joints and said two guiding joints, for blocking and stopping a downwardly movement of said.two guiding joints while unfolding and stretching out said foldable beach chair, so as to partially supporting a weight of a user.

16. A foldable beach chair, as recited in claim 8, wherein a plurality of passing through slots are spacedly and transversally provided on a circumferential surface, of said guiding hole, for preventing, said guiding joints from being stuck during sliding movement, so as to ensure that said guiding joints freely slide along said respective side frame legs.

17. A foldable beach chair, as recited in claim 6, wherein each said guiding joint has an inclined top surface for being flatly supported by said bottom surface of said respective supporting joint.

18. A foldable beach chair, as recited in claim 6, wherein said guiding means further comprises a pair of ring shaped blockers, respectively affixed at said lower portions of said two second side frame legs and positioned between said two front lower frame joints and said two guiding joints, for blocking and stopping a downwardly movement of said two guiding joints while unfolding and stretching out said foldable beach chair, so as to partially supporting a weight of a user.

* * * * *